US011199011B2

(12) United States Patent
Kreller

(10) Patent No.: US 11,199,011 B2
(45) Date of Patent: Dec. 14, 2021

(54) METAL FITTING FOR A TOEBOARD OF A SCAFFOLD

(71) Applicant: Wilhelm Layher Verwaltungs—GMBH, Güglingen-Eibensbach (DE)

(72) Inventor: Helmut Kreller, Bad Rappenau (DE)

(73) Assignee: WILHELM LAYHER VERWALTUNGS—GMBH, Güglingen-Eibensbach (DE)

( * ) Notice: Subject to any disclaimer, the term of this patent is extended or adjusted under 35 U.S.C. 154(b) by 198 days.

(21) Appl. No.: 16/087,775

(22) PCT Filed: Apr. 4, 2017

(86) PCT No.: PCT/EP2017/057979

§ 371 (c)(1),
(2) Date: Sep. 24, 2018

(87) PCT Pub. No.: WO2017/174575

PCT Pub. Date: Oct. 12, 2017

(65) Prior Publication Data

US 2020/0048917 A1 Feb. 13, 2020

(30) Foreign Application Priority Data

Apr. 7, 2016 (DE) ..... 102016106357.6

(51) Int. Cl.
*E04G 7/28* (2006.01)
*E04G 5/14* (2006.01)

(52) U.S. Cl.
CPC ..... *E04G 7/28* (2013.01); *E04G 5/145* (2013.01); *E04G 2007/285* (2013.01)

(58) Field of Classification Search
CPC ..... E04G 5/145; E04G 7/28; E04G 2007/285
See application file for complete search history.

(56) References Cited

U.S. PATENT DOCUMENTS 4,560,301 A * 12/1985 Gilb ..... F16B 9/052 403/232.1
5,004,369 A * 4/1991 Young ..... E04B 7/063 403/232.1

(Continued)

FOREIGN PATENT DOCUMENTS

DE 102012216681 3/2014
EP 0338462 A2 * 10/1989 ..... E04G 7/28

(Continued)

OTHER PUBLICATIONS

Written Opinion and International Search Report of PCT/EP2017/057979 dated May 18, 2017, 16 pages (English and German).

(Continued)

*Primary Examiner* — Colleen M Chavchavadze
(74) *Attorney, Agent, or Firm* — Rankin, Hill & Clark LLP

(57) ABSTRACT

The invention relates to a metal fitting for a toeboard of a scaffolding, comprising a metal fitting body extending in a longitudinal direction of the metal fitting body from a first end region of the metal fitting body designed for connection to a toeboard and/or connected to a toeboard to a second end region of the metal fitting body designed for securing on a scaffolding, wherein at least one securing protrusion is provided in the second end region of the metal fitting body extending substantially in the longitudinal direction of the metal fitting body, characterized in that at least one support protrusion is provided extending in a first transverse direction transverse to the longitudinal direction of the metal fitting body.

10 Claims, 3 Drawing Sheets

(56) References Cited

U.S. PATENT DOCUMENTS

Figure 1:
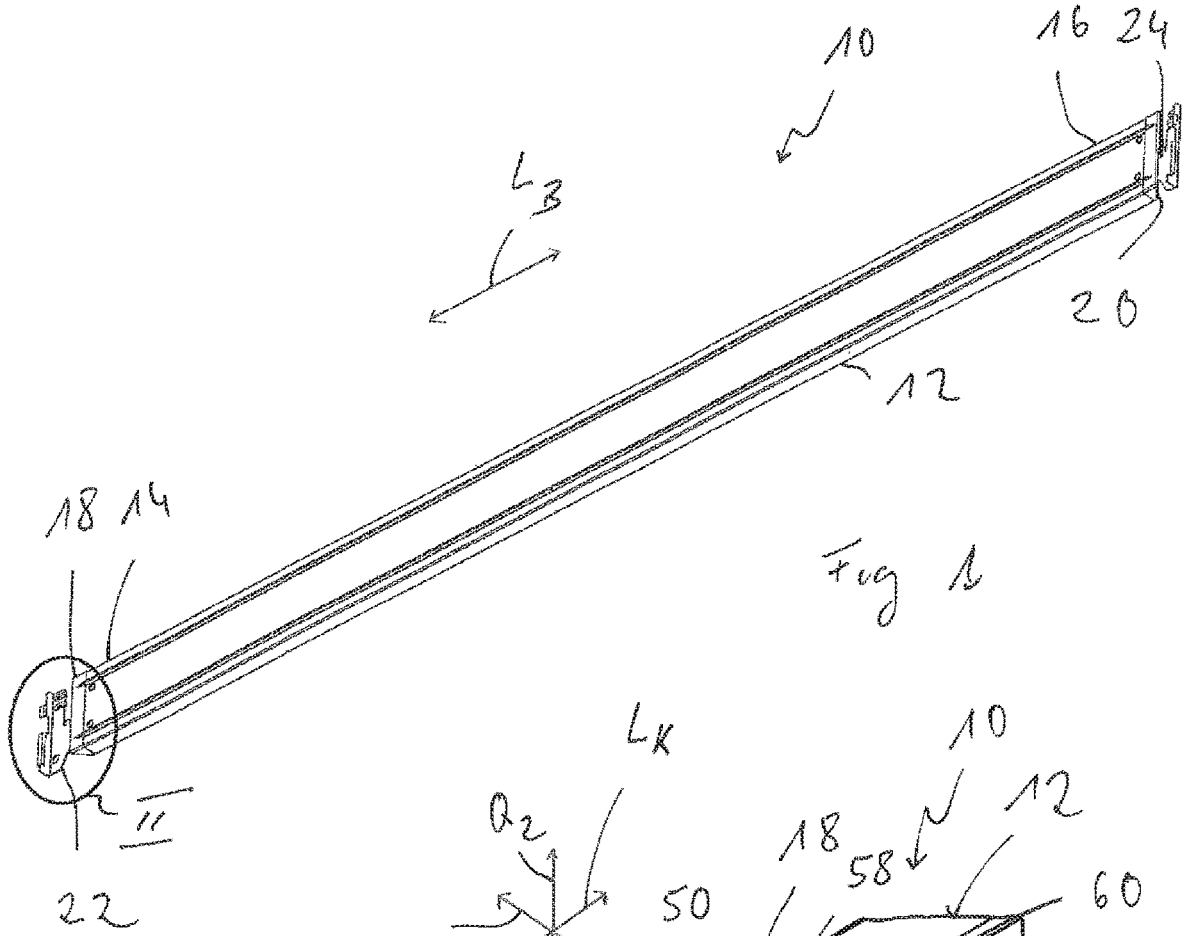

| | | | | |
|---|---|---|---|---|
| 5,284,311 | A * | 2/1994 | Baer | A47B 57/402 248/243 |
| 5,896,721 | A * | 4/1999 | Sugiyama | E04B 1/2604 52/712 |
| 6,607,086 | B1 * | 8/2003 | Gretz | E04B 9/006 211/123 |
| 8,443,569 | B2 * | 5/2013 | Sias | E04B 7/063 52/715 |
| 8,973,707 | B2 * | 3/2015 | Kreller | E04G 7/28 182/113 |
| 9,051,746 | B2 * | 6/2015 | Rogers | E04G 5/08 |
| 10,370,842 | B2 * | 8/2019 | Wesney | E04B 1/40 |
| 2011/0147122 | A1 * | 6/2011 | Canham | E04G 5/06 182/150 |
| 2018/0112420 | A1 * | 4/2018 | Hayman | E04G 5/145 |
| 2020/0048917 | A1 * | 2/2020 | Kreller | E04G 7/28 |

FOREIGN PATENT DOCUMENTS

| | | |
|---|---|---|
| EP | 1801315 | 6/2007 |
| EP | 2281980 | 2/2011 |
| WO | 2005083197 | 9/2005 |

OTHER PUBLICATIONS

International Preliminary Report on Patentability of PCT/EP2017/057979 dated Oct. 18, 2018, 7 pages.

* cited by examiner

METAL FITTING FOR A TOEBOARD OF A SCAFFOLD

The present invention relates to a metal fitting for a toeboard of a scaffolding.

A metal fitting for a toeboard of a scaffolding, for example, a scaffolding frame, is known from EP 2 218 980 A1. This known metal fitting is secured in a first end region of the metal fitting body on a board body of a toeboard and extends, starting from this first end region of the metal fitting body to a second end region of the metal fitting body. In this second end region of the metal fitting body, the metal fitting body of the metal fitting is shaped substantially orthogonally out of a base plane of the metal fitting body to provide an offset region. At the end spaced apart from the base plane of the metal fitting body, the offset region supports a securing protrusion extending substantially across half of the extension length of the offset region. For securing on a scaffolding in an area in which a cross member is secured on a perforated plate of a vertical pole by means of a clamping wedge, a toeboard with its securing protrusion may be positioned engaging into an intermediate space between the clamping wedge and the outer periphery of the vertical pole. A coupling recess is provided in the metal fitting body of this known metal fitting between the two end regions of the metal fitting body; a metal fitting body of another toeboard with its corresponding coupling recess may be positioned engaging in this coupling recess, so that in this way, two toeboards, equipped with this type of known metal fittings, may be coupled to one another to form a safety edge at an angle of approximately 90°.

It is the object of the present invention to provide a metal fitting for a toeboard of a scaffolding, which guarantees with a simple construction a better defined positioning of a toeboard on a scaffolding.

According to the present invention, this problem is solved by a metal fitting for a toeboard of a scaffolding, comprising a metal fitting body extending in a longitudinal direction of the metal fitting body from a first end region of the metal fitting body designed for connection to a toeboard and/or connected to a toeboard to a second end region of the metal fitting body designed for securing to a scaffolding, wherein at least one securing protrusion is provided in the second end region of the metal fitting body extending substantially in the longitudinal direction of the metal fitting body.

Therefore, in addition, at least one support protrusion is provided extending in a first transverse direction transverse to the longitudinal direction of the metal fitting body.

In a metal fitting constructed according to the invention, the at least one securing protrusion and the at least one support protrusion interact during the securing of a toeboard or a fitting of the same on a scaffolding. Similar to the prior art, the securing protrusion may be positioned engaging into an intermediate space, for example, between a clamping wedge and a vertical pole of a scaffolding, wherein this intermediate space is basically significantly larger than the material thickness of the metal fitting, in particular in the region of its at least one securing protrusion. Due to the at least one support protrusion extending substantially transverse to the longitudinal direction of the metal fitting body and thus also substantially transverse to the at least one securing protrusion, the metal fitting may support itself with respect to a vertical pole by bridging the intermediate space between a clamping wedge and the outer periphery of the vertical pole, so that even at larger distances of the clamping wedge from the outer periphery of the vertical pole, the metal fitting may be secured on the scaffolding in a defined position and substantially secured against excessive tipping due to the support protrusion bridging this spacing.

Reference is made to the fact that, in the context of the present invention, the extension direction transverse to the longitudinal direction of the metal fitting body may be, for example, an extension direction that is substantially orthogonal with respect to the longitudinal direction of the metal fitting body. Nevertheless, this extension direction transverse to the longitudinal direction of the metal fitting body, in particular the first transverse direction, may also deviate from an exact orthogonal orientation with respect to the longitudinal direction of the metal fitting body.

In order to be able to couple two toeboards to one another continuing in their longitudinal direction at end regions to be positioned adjacent to one another, or to secure two toeboards on a scaffolding in a simple and stable way, it is proposed that two consecutive securing protrusions are provided in a second transverse direction substantially orthogonal to the longitudinal direction of the metal fitting body and to the first transverse direction.

In order to achieve on the one hand a defined support interaction or securing effect between the metal fitting and a scaffolding, yet also to facilitate on the other hand the securing of two toeboards in end regions adjacent to one another to a scaffolding, it is proposed that the two securing protrusions have different extension lengths in the second transverse direction, and/or that the support protrusion follows the two securing protrusions in the second transverse direction, and/or that a longer of the two securing protrusions is arranged between the support protrusion and a shorter of the two securing protrusions in the second transverse direction.

A stable support interaction, even under the application of force, may be guaranteed by means of the at least one support protrusion, in that the support protrusion projects in the first transverse direction substantially orthogonally out of a base plane of the metal fitting body.

In order to be able to guarantee a defined positioning of a toeboard in the longitudinal direction of the same with respect to a scaffolding, thus to secure the toeboard against displacement in its longitudinal direction, it is proposed that the at least one securing protrusion is offset in the first transverse direction with respect to a base plane of the metal fitting body, wherein this offset may preferably be achieved in that the metal fitting body has an offset region projecting substantially out of the base plane of the metal fitting body in the first transverse direction and supporting the at least one securing protrusion, wherein the support protrusion extends past the at least one securing protrusion in the first transverse direction. By using the offset region, a metal fitting may then, for example, be supported by its securing projection engaging from behind on a clamping wedge of a horizontal bar.

For an efficient support effect of the at least one support protrusion while simultaneously maintaining the possibility of connecting two continuing toeboards to one another at end regions contacting one another or to secure two toeboards to a scaffolding, it is proposed that the support protrusion is provided on an offset end region of the offset region in a second transverse direction substantially orthogonal to the longitudinal direction of the metal fitting body and to the first transverse direction.

According to another construction principle, particularly advantageous in connection with the previously described aspects, yet also representing an independent aspect of the invention, it may be provided that an open coupling recess is provided in the metal fitting body in a second transverse direction substantially orthogonal to the longitudinal direction of the metal fitting body and to the first transverse direction between the first end region of the metal fitting body and the second end region of the metal fitting body, wherein the coupling recess has at least two coupling slots in a recess base region extending substantially in the second transverse direction and arranged spaced apart from one another in the longitudinal direction of the metal fitting body. The at least two coupling slots thus facilitate the coupling of two metal fittings or toeboards equipped with the same, for example, at an angle of approximately 90° to one another in positions offset to one another corresponding to the spacing of the coupling slots.

The width of the coupling slots in the longitudinal direction of the metal fitting body thereby corresponds substantially to a material thickness of the metal fitting body. This means, in the context of the present invention, that the coupling slots are dimensioned such that a metal fitting body of another toeboard or of another metal fitting may be inserted in said coupling slots; however, without accommodating substantial movement play therein.

For reasons of a simple and cost-efficient manufacturing, it is proposed that the metal fitting body is a shaped sheet metal part.

The invention additionally relates to a toeboard for a scaffolding, comprising a board body with end regions of the board body lying spaced apart from one another in a longitudinal direction of the board body, wherein a metal fitting designed according to the invention is connected to the board body in at least one, preferably in both end regions of the board body.

The invention additionally relates to a scaffolding, in particular a scaffolding frame, comprising a plurality of vertical poles and a plurality of horizontal bars connected to the vertical poles, and at least one, preferably a plurality, of toeboards according to the invention.

At least one horizontal bar may thereby be connected to a vertical pole by means of a clamping wedge engaging through a perforated disk provided on the vertical pole. A securing protrusion of a metal fitting of a toeboard may be inserted into an intermediate space formed between the clamping wedge and the vertical pole to support itself on the clamping wedge. The at least one support protrusion provided on this metal fitting may be supported on an outer periphery of the vertical pole and thus guarantees a defined positioning of the toeboard substantially secured against excessive tipping.

Figure 2:
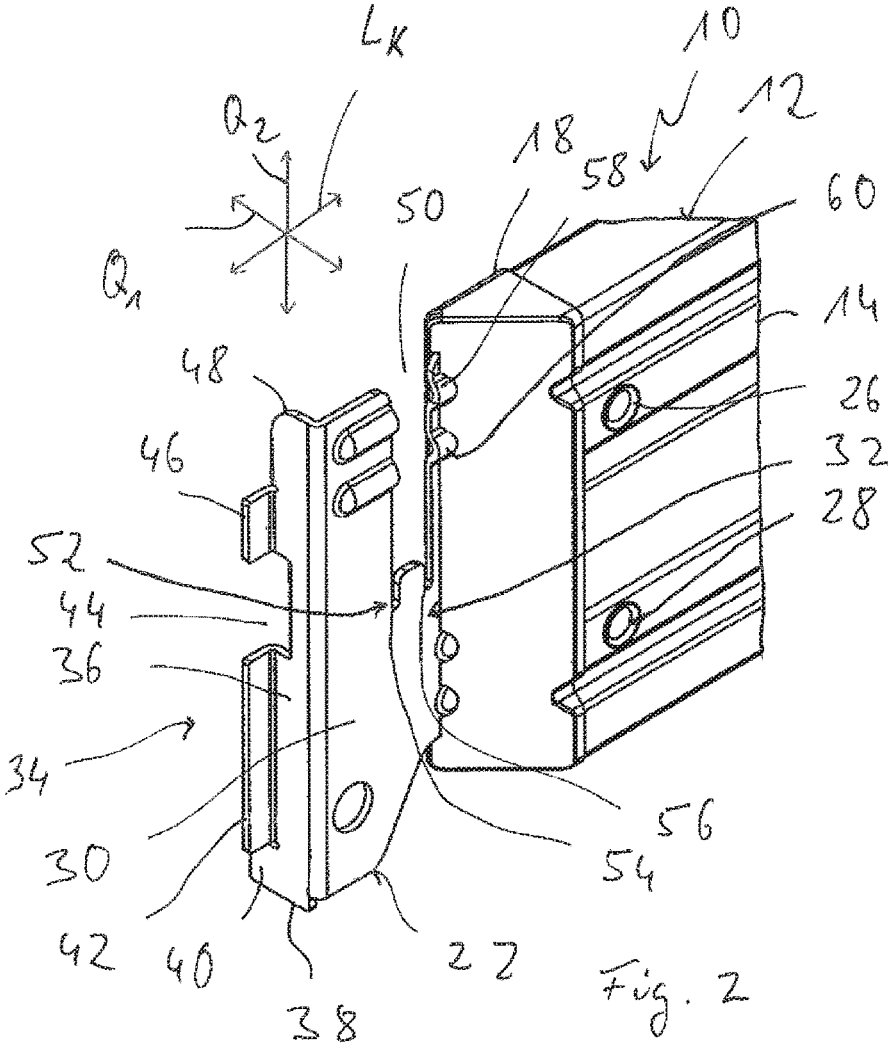
Figure 3:
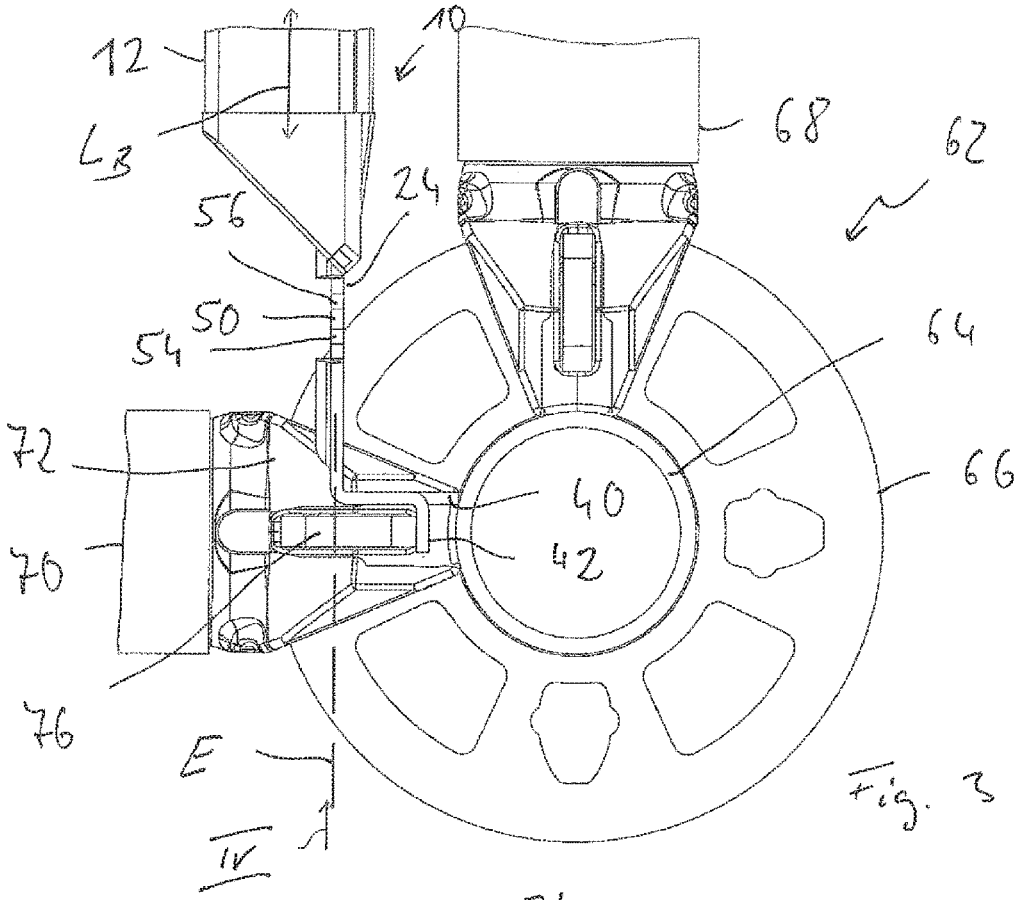
Figure 4:
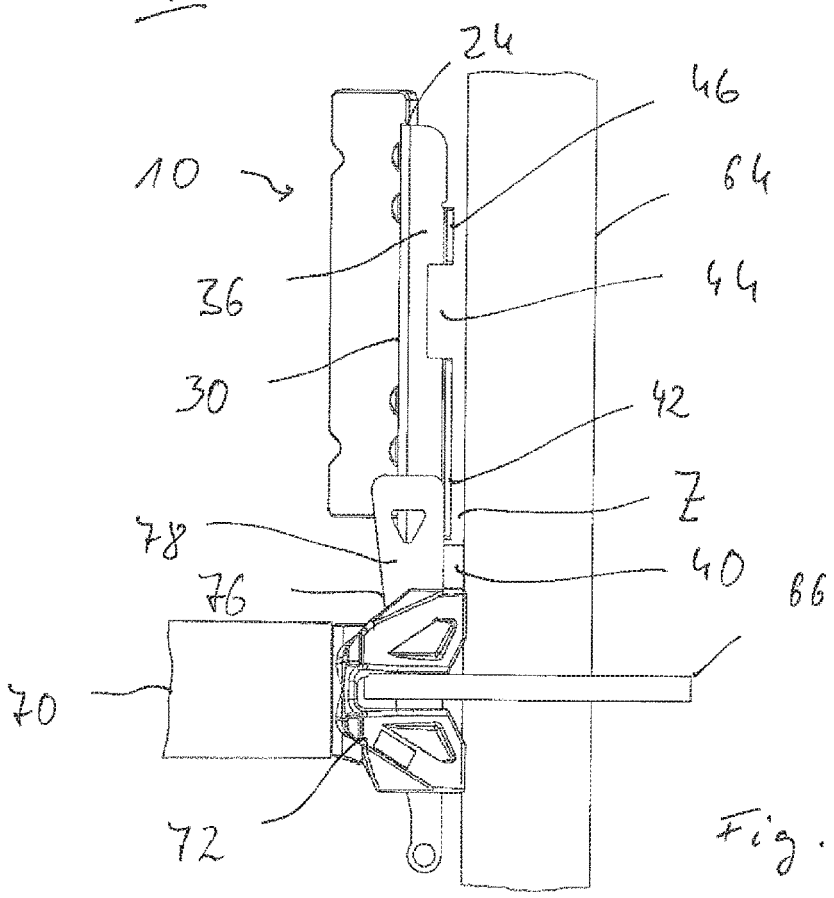
Figure 5:
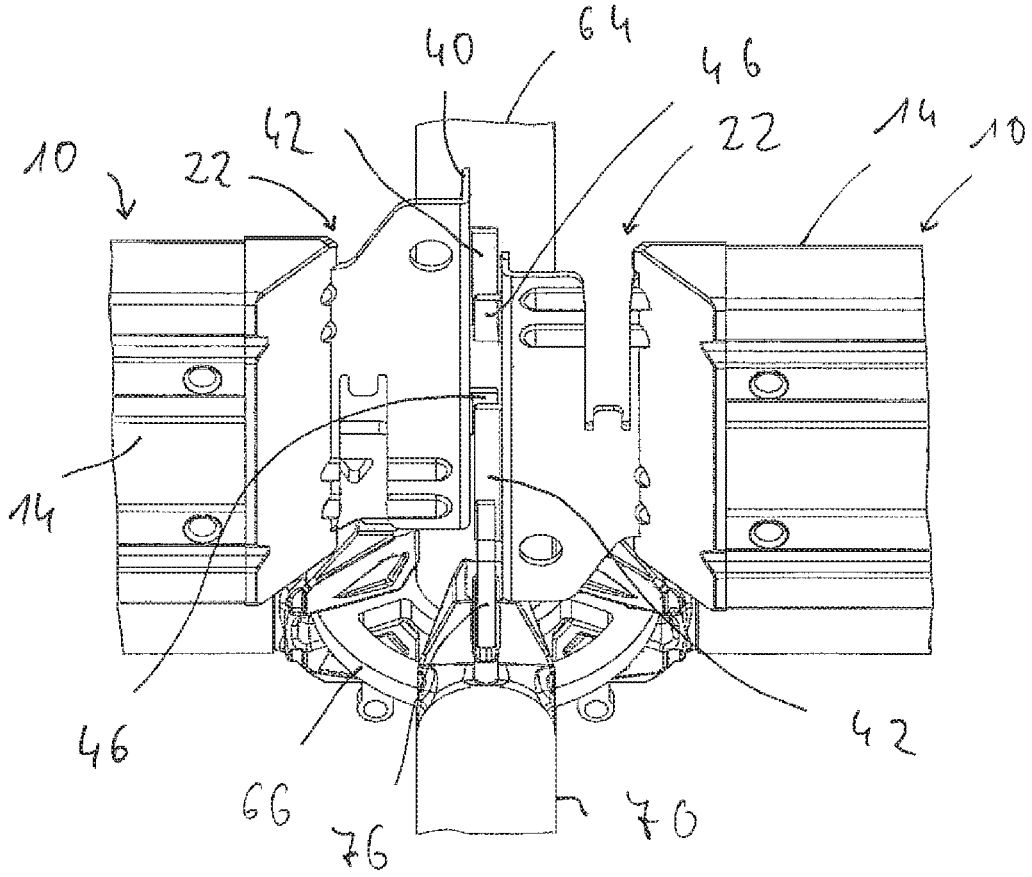

The present invention is subsequently described in detail with reference to the appended figures. As shown in:

FIG. 1 a toeboard for a scaffolding in a perspective view;

FIG. 2 an enlarged view of detail II in FIG. 1;

FIG. 3 a top view of a vertical pole provided with a perforated disk and connected to two horizontal bars and a toeboard secured thereon in this area;

FIG. 4 the scaffolding area from FIG. 3 in line of sight IV in FIG. 3;

FIG. 5 a vertical pole in a side view with a horizontal bar connected thereto and two toeboards fixed on a scaffolding in this area.

FIGS. 1 and 2 show a toeboard generally designated with 10, which may be arranged as a safety element in a scaffolding, for example, a scaffolding frame, close to a scaffolding platform element extending along its edge region. Toeboard 10 has, for example, a board body 12 produced, for example, from aluminum material in an extrusion process and extending longitudinally in a longitudinal direction $L_B$ of the board body with two end regions 14, 16 of the board body. At each of end regions 14, 16 of the board body, board body 12, generally designed as a hollow body, is closed by cap element 18 or 20 constructed from plastic material. A metal fitting 22, 24, by means of which toeboard 10 may be secured on a scaffolding, is secured on each of end regions 14, 16 of the board body together with respective cap element 18 or 20. The securing may be carried out, for example, by rivet elements 26, 28 indicated in FIG. 2.

The design of metal fittings 22, 24 is subsequently described in greater detail. Reference is made to the fact that the two metal fittings 22, 24 are designed substantially mirror symmetrically to one another; however, basically have the same structural elements, which are subsequently designated with the same reference numerals in assignment to both metal fittings 22, 24.

Metal fitting 22, clearly visible in FIG. 2, has a metal fitting body generally designated with 30 and designed, for example, as a shaped sheet metal part. Metal fitting body 30 is inserted into toeboard 12 using a first end region 32 of the metal fitting body and is secured in the previously described way. Metal fitting body 30 is designed for securing on a scaffolding frame in a second end region 34 of the metal fitting body.

Metal fitting body 30 extends between its two end regions 32, 34 of the metal fitting body in a longitudinal direction $L_K$ of the metal fitting body, which substantially corresponds to the toeboard longitudinal direction $L_B$ when metal fitting 22 or 24 is applied on a toeboard. Metal fitting body 30 lies substantially in a base plane E of the metal fitting body. In second end region 34 of the metal fitting body, an offset region 36 is provided extending in a first transverse direction $Q_1$ transversely from base plane E of the metal fitting body, thus, for example, substantially orthogonal. Said offset region may extend in a second transverse direction $Q_2$ with respect to longitudinal direction $L_K$ of the metal fitting body preferably substantially across the entire width of metal fitting body 30. Reference is made here to the fact that second transverse direction $Q_2$ may be, for example, orthogonal to first direction $Q_1$ so that a coordinate system with orthogonally oriented coordinate axes is defined by longitudinal direction $L_K$ of the metal fitting body, first transverse direction $Q_1$, and second transverse direction $Q_2$.

In FIG. 2 in second transverse direction $Q_2$, a support protrusion 40 is provided on a lower-lying end region 38 of offset region 36 and extending farther out of base plane E of the metal fitting body in first transverse direction $Q_1$ across offset region 36. Said support protrusion is thus essentially orthogonal to base plane E of the metal fitting body.

Subsequent to support protrusion 40 in second transverse direction $Q_2$, a first securing protrusion 42 is provided on offset region 36 extending substantially in longitudinal direction $L_K$ of the metal fitting body. Support protrusion 40 extends in second transverse direction $Q_2$ and in the direction away from base plane E of the metal fitting body past that region, in which a first securing region 42 is arranged extending offset with respect to base plane E of the metal fitting body and extending in longitudinal direction $L_K$ of the metal fitting body.

On the side of securing protrusion 42 facing away from support protrusion 40, a recess 44 is provided extending inward up to offset region 36. A second securing protrusion 46, which follows this recess, lies in the same plane as first securing protrusion 42, is offset with respect to base plane E of the metal fitting body, and likewise extends in longitudinal direction $L_K$ of the metal fitting body. Second securing protrusion 46 has a smaller extension length in second transverse direction $Q_2$ than first securing protrusion 42 and ends, for example, in front of a second end region 48 of offset region 36 when viewed in second transverse direction $Q_2$.

Between first end region 32 of the metal fitting designed for connecting to toeboard 12 and second end region 34 of the metal fitting designed for securing on scaffolding, an open coupling recess 50 is provided in the region of metal fitting body 30 lying in base plane E of the metal fitting body, in second transverse direction $Q_2$, namely in a direction away from support protrusion 40. Coupling recess 50 has an extension length, thus, for example, a width in longitudinal direction $L_K$ of the metal fitting body that is significantly larger than the material thickness of metal fitting body 30. In a base region 52 lying, for example, approximately in the central region with respect to second transverse direction $Q_2$, coupling recess 50 ends in two coupling slots 54, 56 extending substantially in second transverse direction $Q_2$ and arranged spaced apart from one another in longitudinal direction $L_K$ of the metal fitting body. Coupling slots 54, 56 have a width in longitudinal direction $L_K$ of the metal fitting body which substantially corresponds to or is slightly greater than the material thickness of metal fitting body 30, so that a metal fitting or a metal fitting body of another toeboard 10 may be inserted into recess 50 shown in FIG. 2, so that, for example the two toeboards with their coupling slots 54 engaging in one another may be coupled together at an angle of approximately 90°. According to the installation situation, as already explained, two coupling slots 54 or two coupling slots 56 are positioned engaging in one another, or coupling slot 54 of one metal fitting may be positioned engaging in one another with coupling slot 56 of the other metal fitting.

Providing a comparatively wide coupling recess 50 initially facilitates the insertion into one another of the two metal fittings to be coupled to one another. At the end of the insertion movement, a defined coupling of the two toeboards to one another is guaranteed and substantially secured against tipping due to the coupling slots engaging into one another.

To increase the stability of metal fitting body 30, multiple bead-like moldings 58, 60 are provided extending, for example, in longitudinal direction $L_K$ of the metal fitting body. These bead-like moldings might also or additionally be provided on other regions of metal fitting body 30, preferably the region lying in base plane E of the metal fitting body.

The securing of toeboard 10, designed with metal fittings 22, 24, on a scaffolding, for example, a scaffolding frame, will be subsequently explained with reference to FIGS. 3 and 4. Reference is thereby made to the fact that end region 16 of the toeboard and metal fitting 24 provided thereon are clearly visible in FIGS. 3 and 4. As already explained, said metal fitting has the same structural elements designated with the same reference numerals as metal fitting 22 depicted in detail in FIG. 2.

A region of scaffolding 62, for example, a scaffolding frame, is clear in FIGS. 3 and 4. A vertical pole 64, which extends in constructed scaffolding 62 substantially in the height direction, thus in the vertical direction, is provided in this region of scaffolding 62. A perforated plate 66 is secured on vertical pole 64, for example, by welding. In the region of scaffolding 62 shown, two horizontal bars 68, 70 are coupled to vertical pole 64 by means of perforated plate 66. Each of horizontal bars 68, 70 has a wedge head 72 for coupling to vertical pole 64 or perforated plate 66; said wedge head is positioned using a jaw opening 74 to encompass perforated plate 66 in the region of a perforation of the same. A clamping wedge 76 provided on wedge head 72 may be guided through the opening of perforated disk 66 encompassed by wedge head 72 and thus respective wedge head 72 and may thus anchor horizontal bar 70 or 68 stably on vertical pole 64. In this state, an intermediate space Z, open toward the top, is formed between region 78 of clamping wedge 76 projecting upward over wedge head 72 and vertical pole 64. Said intermediate space Z is used to secure toeboard 10 with its metal fitting 24 to scaffolding 62 as is also clear in FIGS. 3 and 4.

In addition, metal fitting 24 with its end region 34 of the metal fitting body, or first securing protrusion 42 provided thereon engaging behind region 78 of clamping wedge 76, is inserted from above into intermediate space Z. Support protrusion 40 is dimensioned so that its protrusion length is past first securing protrusion 42 in such a way that in the case that first securing protrusion 42 contacts or is supported on region 78, support protrusion 40 is supported on vertical pole 64 or lies at a small distance therefrom. Metal fitting 24 with its second end region 34 of the metal fitting body is thus accommodated with only low movement play in intermediate space Z between region 78 of clamping wedge 76 and vertical pole 64, so that toeboard 10 has an orientation substantially parallel to the extension direction of vertical pole 64, approximately corresponding to the depiction of FIG. 4, and is secured against excessive tipping. Due to the engagement of first securing protrusion 42 into intermediate space Z and the inevitably occurring support thereby of support projection 40 on vertical pole 64, a stable securing or hooking of toeboard 10 on scaffolding 62 is guaranteed even under the effect of gravity.

Due to the slight over-dimensioning of intermediate space Z, necessary for facilitating the insertion of first securing protrusion 42 into intermediate space Z, toeboard 10 does not actually adopt the exactly parallel alignment to vertical pole 64 depicted in FIG. 4, but instead is tipped slightly at a slight angle with respect thereto, so that second securing protrusion 46, also clear in FIG. 4, actually has a somewhat larger spacing from vertical pole 64 than first securing protrusion 42. This is used in the manner subsequently described in order to be able to also secure a second toeboard on scaffolding 62 in the region depicted in FIGS. 3 and 4, which continues toeboard 10 in its longitudinal direction $L_B$ of the board body.

Since toeboard 10 with its metal fitting 24 and likewise its metal fitting 22 is secured on scaffolding 62 substantially without play and secured against excessive tipping, the risk that toeboard 10 is accidentally lifted out of intermediate space Z, for example, by opening an access hatch, is largely eliminated. Also, during coupling of two toeboards at an angle of 90° to one another using coupling recesses 50 in metal fittings 22 or 24 of the same, a defined positioning is and excessive tipping of the toeboards with respect to one another is prevented.

If two toeboards are to be continuously connected to scaffolding 62 in the respective longitudinal direction $L_B$ of the board bodies, then, as this is shown in FIG. 5, initially one of the toeboards, namely toeboard 10, extending to the right with respect to vertical pole 64 in FIG. 5 with its metal fitting 22, may be secured in the previously described way on scaffolding 62, so that first securing protrusion 42 of the same engages behind region 78 of clamping wedge 76, wherein the support protrusion (not visible in FIG. 5) of metal fitting 22 is supported on vertical pole 64. Toeboard 10 extending to the left with respect to vertical pole 64 in FIG. 5, is guided in a position rotated 180° about its longitudinal axis $L_B$ of the board body, so that its coupling recess 50 is open facing downward, while coupling recess 50 of toeboard 10, already secured on scaffolding 62 and extending to the right, is open facing upward, as is also the case in FIGS. 3 and 4, and is ready for coupling to a toeboard extending orthogonal to said toeboard 10 in the previously described way. Toeboard 10, extending to the left in FIG. 5, is inserted with its two securing protrusions 46, 42 from above into the intermediate space between securing protrusions 42 and 46 of toeboard 10, which is already secured on scaffolding frame 62, and vertical pole 64, which is possible due to the previously discussed slight tipping of already secured toeboard 10. Since, in the case of the toeboard that extends to the left in FIG. 5 and remains to be secured, support protrusion 40 of metal fitting 22 of the same lies above due to the rotation of 180°, said support protrusion prevents the insertion of securing protrusions 42, 46 of this metal fitting 22 behind protrusions 42, 46 of metal fitting 22 already fixed on scaffolding 62.

Toeboard 10 extending to the left engages with its securing protrusion 46 behind securing protrusion 42 of toeboard 10, which is already secured on scaffolding 62, and engages with its securing protrusion 42 behind securing protrusion 46 of the other toeboard 10. Toeboard 10 extending to the left may be pushed downward until support protrusion 40 of the same strikes vertical pole 64, in order to thus achieve a clamping, wedge-like securing effect, both for this toeboard 10 and also for toeboard 10 already secured on scaffolding 62. The two toeboards lie in this state approximately at the same height or have no offset or only a slight offset with respect to one another in the height direction, thus in the extension direction of vertical pole 64.

Reference should be made to the fact that the previously described configuration of a metal fitting for a toeboard may also be used for different configurations of a toeboard, thus for the configuration of the board body as a wooden component, or also for other configurations of the scaffolding, thus, in particular also for different types of coupling between the vertical poles and the horizontal bars. It only requires an intermediate space between, for example, a vertical pole and an element arranged at a distance thereto to generate intermediate space Z. This might also be formed on a horizontal bar detachably connected from above to a vertical pole.

In addition, reference is made to the fact that the two securing protrusions may also be provided as integral bent parts merging into one another from the offset region. The provision of recess 44, visible primarily in FIG. 2, may be advantageous in order to thus create installation space for, for example, construction elements provided on the vertical pole, or to prevent mutual interference between a metal fitting and a construction element of this type; however, at the same time facilitating the previously described was of securing a toeboard on a scaffolding.

The invention claimed is:

1. A metal fitting for a toeboard of a scaffolding, comprising a metal fitting body provided as a shaped sheet metal part and extending in a metal fitting body base plane in a longitudinal direction of the metal fitting body from a first end region of the metal fitting body, configured to be connected to the toeboard, to a second end region of the metal fitting body, configured to be secured on a scaffolding, wherein the metal fitting body has an offset region projecting in a first transverse direction transverse to the longitudinal direction of the metal fitting body out of the metal fitting body base plane of the metal fitting body, wherein, in the second end region of the metal fitting body, at least one securing protrusion is supported at the offset region so as to be offset in the first transverse direction relative to the metal fitting body base plane of the metal fitting body and to extend from the offset region parallel to the metal fitting body base plane in a direction away from the first end region in the longitudinal direction of the metal fitting body, wherein at least one support protrusion is provided extending in the first transverse direction past the at least one securing protrusion.

2. The metal fitting according to claim 1 wherein the at least one securing protrusion includes two consecutive securing protrusions provided in a second transverse direction substantially orthogonal to the longitudinal direction of the metal fitting body and to the first transverse direction.

3. The metal fitting according to claim 2, wherein the two securing protrusions have different extension lengths in the second transverse direction, and/or that the support protrusion follows the two securing protrusions in the second transverse direction, and/or that a longer of the two securing protrusions is arranged between the support protrusion and a shorter of the two securing protrusions in the second transverse direction.

4. The metal fitting according to claim 1 wherein the support protrusion projects in the first transverse direction substantially orthogonally out of the metal fitting body base plane of the metal fitting body.

5. The metal fitting according to claim 1, wherein the support protrusion is provided on an end region of the offset region in a second transverse direction substantially orthogonal to the longitudinal direction of the metal fitting body and to the first transverse direction.

6. The metal fitting according to claim 1, wherein an open coupling recess is provided in the metal fitting body between the first end region of the metal fitting body and the second end region of the metal fitting body in a second transverse direction substantially orthogonal to the longitudinal direction of the metal fitting body and to the first transverse direction, wherein the coupling recess has at least two coupling slots in a recess base region extending substantially in the second transverse direction and arranged spaced apart from one another in the metal fitting body longitudinal direction.

7. The metal fitting according to claim 6, wherein a width of the coupling slots in the longitudinal direction of the metal fitting body substantially corresponds to a material thickness of the metal fitting body.

8. A toeboard for a scaffolding, comprising a board body with end regions of the board body lying spaced apart from one another in a longitudinal direction of the board body, wherein a metal fitting is connected to the board body in at least one of the end regions of the board body, wherein the metal fitting includes a metal fitting body provided as a shaped sheet metal part and extending in a metal fitting body base plane in a longitudinal direction of the metal fitting body from a first end region of the metal fitting body configured to be connected to the board body to a second end region of the metal fitting body configured to be secured on the scaffolding, wherein the metal fitting body has an offset region projecting in a first transverse direction transverse to the longitudinal direction of the metal fitting body out of the metal fitting body base plane of the metal fitting body, wherein, in the second end region of the metal fitting body, at least one securing protrusion is supported at the offset region so as to be offset in the first transverse direction relative to the metal fitting body base plane of the metal fitting body and to extend from the offset region parallel to the metal fitting body base plane in a direction away from the first end region in the longitudinal direction of the metal fitting body, wherein at least one support protrusion is provided extending in the first transverse direction past the at least one securing protrusion;

wherein the at least one securing protrusion includes two consecutive securing protrusions provided in a second transverse direction substantially orthogonal to the longitudinal direction of the metal fitting body and to the first transverse direction; and wherein the two securing protrusions have different extension lengths in the second transverse direction, and/or the support protrusion follows the two securing protrusions in the second transverse direction, and/or a longer of the two securing protrusions is arranged between the support protrusion and a shorter of the two securing protrusions in the second transverse direction.

9. A scaffolding frame, comprising a plurality of vertical poles and a plurality of horizontal bars connected to the vertical poles, and at least one toeboard, the toeboard including a board body with end regions of the board body lying spaced apart from one another in a longitudinal direction of the board body, wherein a metal fitting is connected to the board body in at least one of the end regions of the board body, wherein the metal fitting includes a metal fitting body provided as a shaped sheet metal part and extending in a metal fitting body base plane in a longitudinal direction of the metal fitting body from a first end region of the metal fitting body connected to the body board to a second end region of the metal fitting body designed for securing on the scaffolding frame, wherein the metal fitting body has an offset region projecting in a first transverse direction transverse to the longitudinal direction of the metal fitting body out of the metal fitting body base plane of the metal fitting body, wherein, in the second end region of the metal fitting body, at least one securing protrusion is supported at the offset region so as to be offset in the first transverse direction relative to the metal fitting body base plane of the metal fitting body and to extend from the offset region parallel to the metal fitting body base plane in a direction away from the first end region in the longitudinal direction of the metal fitting body, wherein at least one support protrusion is provided extending in the first transverse direction past the at least one securing protrusion;

wherein the at least one securing protrusion includes two consecutive securing protrusions provided in a second transverse direction substantially orthogonal to the longitudinal direction of the metal fitting body and to the first transverse direction; and wherein the two securing protrusions have different extension lengths in the second transverse direction, and/or the support protrusion follows the two securing protrusions in the second transverse direction, and/or a longer of the two securing protrusions is arranged between the support protrusion and a shorter of the two securing protrusions in the second transverse direction.

10. The scaffolding according to claim 9, wherein at least one horizontal bar is connected to a vertical pole by means of a clamping wedge engaging through a perforated plate provided on the vertical pole, wherein a securing protrusion of a metal fitting of a toeboard is inserted into an intermediate space formed between the clamping wedge and the vertical pole and is supported on the clamping wedge, and a support protrusion of the metal fitting is supported on an outer periphery of the vertical pole.

* * * * *